US006179662B1

(12) United States Patent
Kuo

(10) Patent No.: US 6,179,662 B1
(45) Date of Patent: Jan. 30, 2001

(54) CABLE END CONNECTOR

(75) Inventor: Peter Kuo, Chung-Ho (TW)

(73) Assignee: Hon Hai Precision Ind. Co., Ltd., Taipei Hsien (TW)

( * ) Notice: Under 35 U.S.C. 154(b), the term of this patent shall be extended for 0 days.

(21) Appl. No.: 09/329,092

(22) Filed: Jun. 9, 1999

(30) Foreign Application Priority Data

Nov. 6, 1998 (TW) ..... 87218447

(51) Int. Cl.[7] ..... H01R 13/648
(52) U.S. Cl. ..... 439/607; 439/76.1
(58) Field of Search ..... 439/76.1, 607–610

(56) References Cited

U.S. PATENT DOCUMENTS 5,797,771 * 8/1998 Garside ..... 439/610
5,941,725 * 8/1999 Brennan et al. ..... 439/357
5,980,320 * 11/1999 Slack et al. ..... 439/607
6,050,852 * 4/2000 Wu ..... 439/607

* cited by examiner

*Primary Examiner*—Khiem Nguyen
(74) *Attorney, Agent, or Firm*—Wei Te Chung

(57) ABSTRACT

A cable end connector includes a conductive casing having two spaced wall plates connected by a peripheral edge face. An insulative body has retaining legs extending into the casing via an opening defined in the edge face to support the body on the edge face. A circuit board is arranged in the casing in electrical connection with contact elements retained in the body. A shielding member is attached to the body by inserting four retaining legs thereof through holes defined in the body. Each wall plate of the casing has two cantilevered members each defining a slot for receiving and engaging the corresponding retaining leg. The leg is bent an angle for being secured in the slot. The slot has a cantilevered section having an inclined flange for surface-contacting and electrically engaging the bent portion of the retaining leg. The cantilevered structures of the cantilevered member and cantilevered section provide resiliency for forming secure engagement between the cantilevered member and the retaining leg. A plurality of wires extend into the casing through a second opening defined therein to be electrically connected to the circuit board.

12 Claims, 5 Drawing Sheets

CABLE END CONNECTOR

BACKGROUND OF THE INVENTION

1. Field of the Invention

The present invention generally relates to a cable end connector, and in particular to a cable end connector having an EMI shield securely fixed to a casing thereof.

2. The Prior Art

Electrical/electronic devices are usually connected together by means of electrical cables. The electrical cable may have an end connector for facilitating connection with the electrical/electronic devices. To suppress electromagnetic interference (EMI), the cable and the end connector are commonly enclosed by a conductive member which is grounded. However, such a conventional configuration complicates the manufacturing process.

To overcome the problem, Taiwan Patent Application Nos. 82109498, 83215903, 84200785 and 84206625 teach arranging a circuit board in the cable end connector for electrically connecting the cable to contact elements of the connector. The circuit board is enclosed by a casing formed by two casing members. The casing members have projections and recesses engaging with each other for fixing the two members together. However, the casing members have no securing means thus the casing members may become detached from each other leading to deterioration of EMI protection.

It is thus desirable to provide a cable end connector which overcomes the above problems of the prior art cable end connectors.

SUMMARY OF THE INVENTION

Accordingly, an object of the present invention is to provide a cable end connector having casing members securely fixed together and forming a secure electrical engagement with a shielding member for enhanced EMI protection and grounding purposes.

To achieve the above objects, a cable end connector in accordance with the present invention comprises a conductive casing having two spaced wall plates connected by a peripheral edge face. An insulative body has retaining legs extending into the casing via an opening defined in the edge face to support the body on the edge face. A circuit board is arranged in the casing in electrical connection with contact elements retained in the body. A shielding member is attached to the body by inserting four retaining legs thereof through holes defined in the body. Each wall plate of the casing has two cantilevered members each defining a slot for receiving and engaging the corresponding retaining leg. The leg is bent an angle for being secured in the slot. The slot has a cantilevered section having an inclined flange for surface-contacting and electrically engaging the bent portion of the retaining leg. The cantilevered structures of the cantilevered member and cantilevered section provide resiliency for forming secure engagement between the cantilevered member and the retaining leg. A plurality of wires extend into the casing through a second opening defined therein to be electrically connected to the circuit board.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF PREFERRED EMBODIMENT

Figure 1:
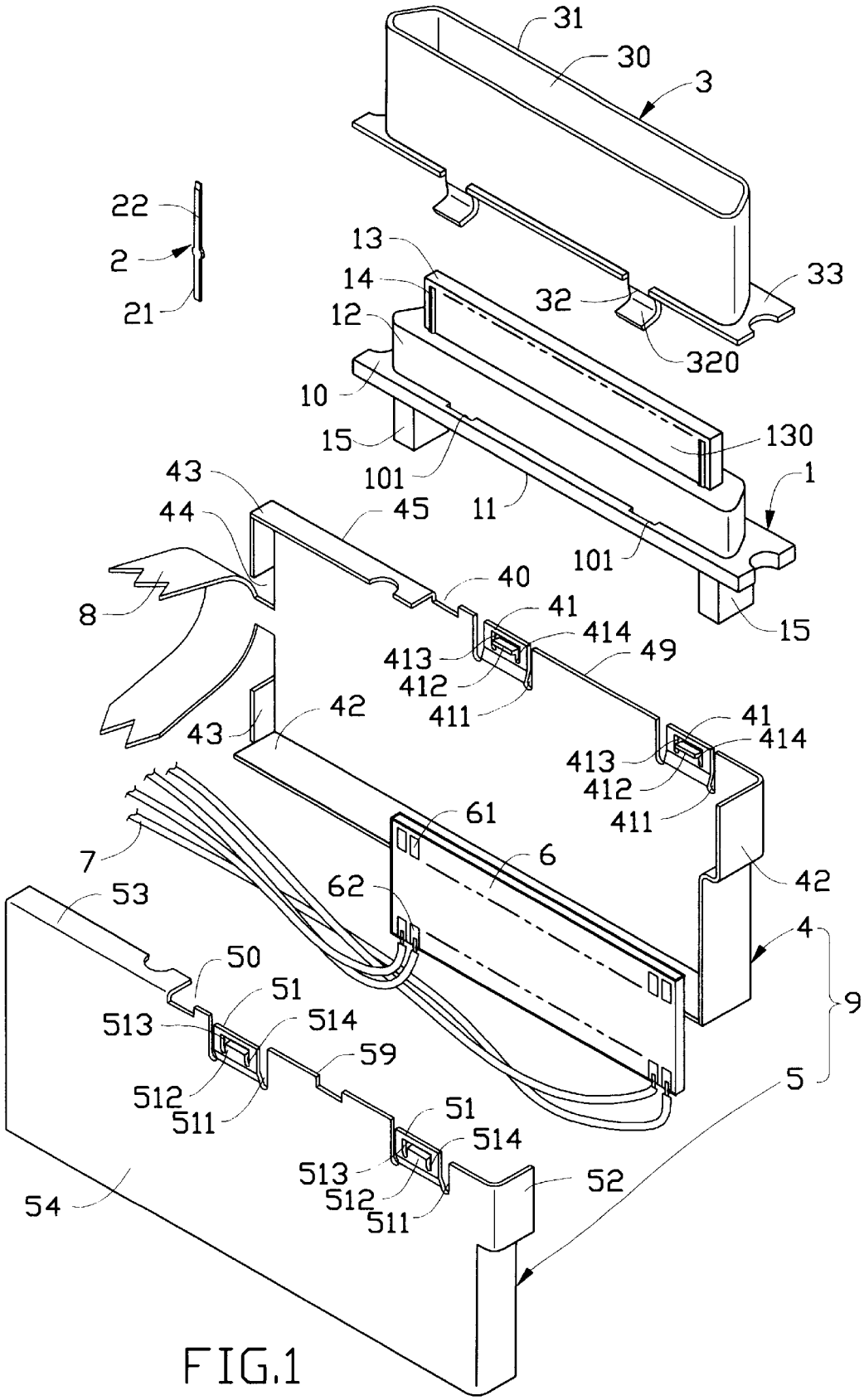
FIG. 1 is an exploded view of a cable end connector constructed in accordance with the present invention.
Figure 2:
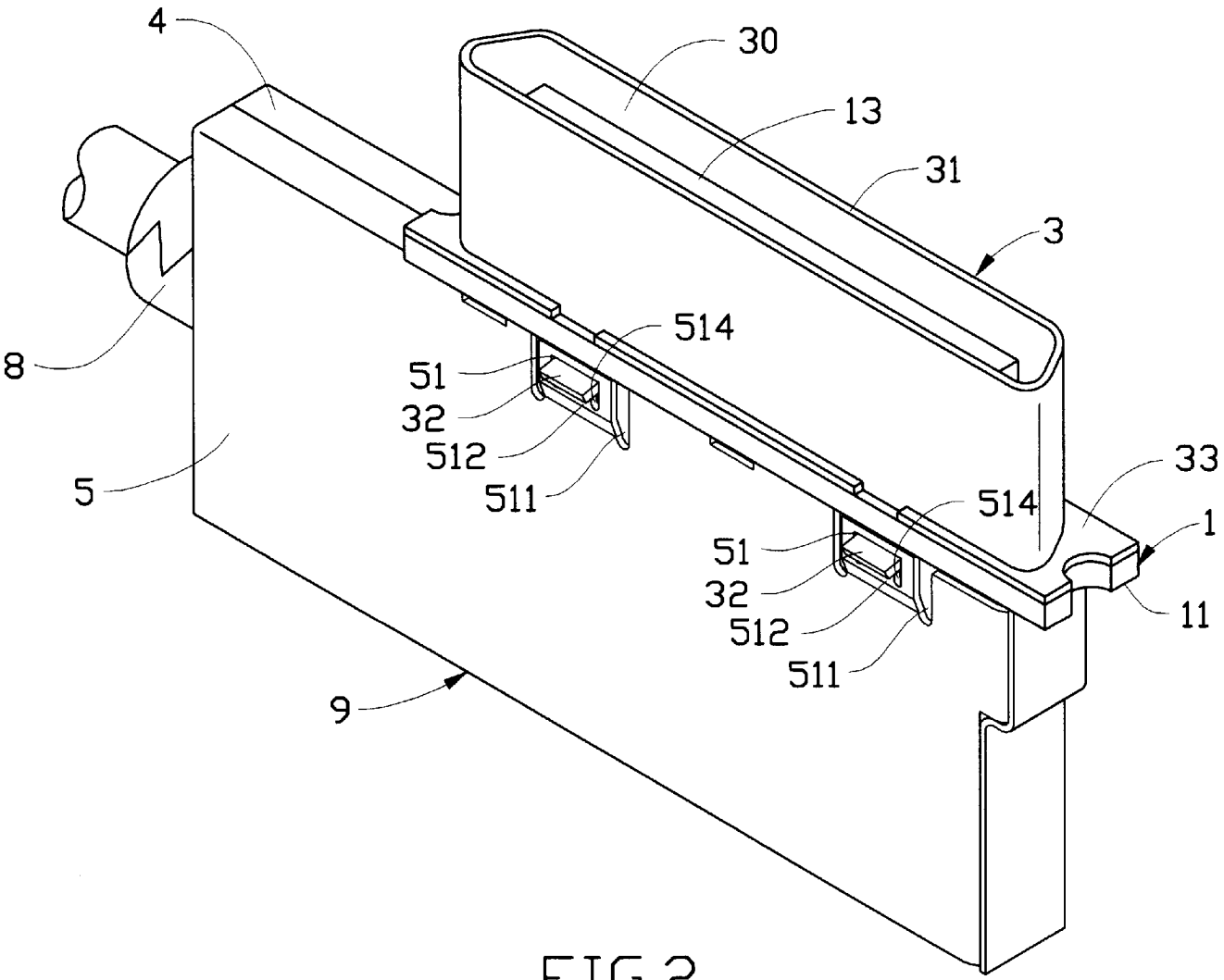
FIG. 2 is an assembled view of the cable end connector of the present invention.

Referring to the drawings and in particular to FIGS. 1 and 2, a cable end connector in accordance with the present invention comprises an insulative body 1 having a top face 10 and a bottom face 11. A coupling section 12 extends from the top face 10 and a contact support member 13 further extends from the coupling section 12. The contact support member 13 has opposite surfaces 130 and defines a plurality of contact receiving channels 14 exposed to the surfaces 130 thereof. The contact receiving channels 14 are further defined through the coupling section 12 and exposed to the bottom face 11 of the body 1. Each contact receiving channel 14 receives and retains a contact element 2 therein. Each contact element 2 has a mating end 22 located in the contact support member 13 and exposed to the surface 130 thereof for electrically engaging with an external contact (not shown), and a mounting end 21 extending beyond the bottom face 11 of the body 1. The body 1 also has two retaining legs 15 extending from the bottom face thereof.

Figure 3:
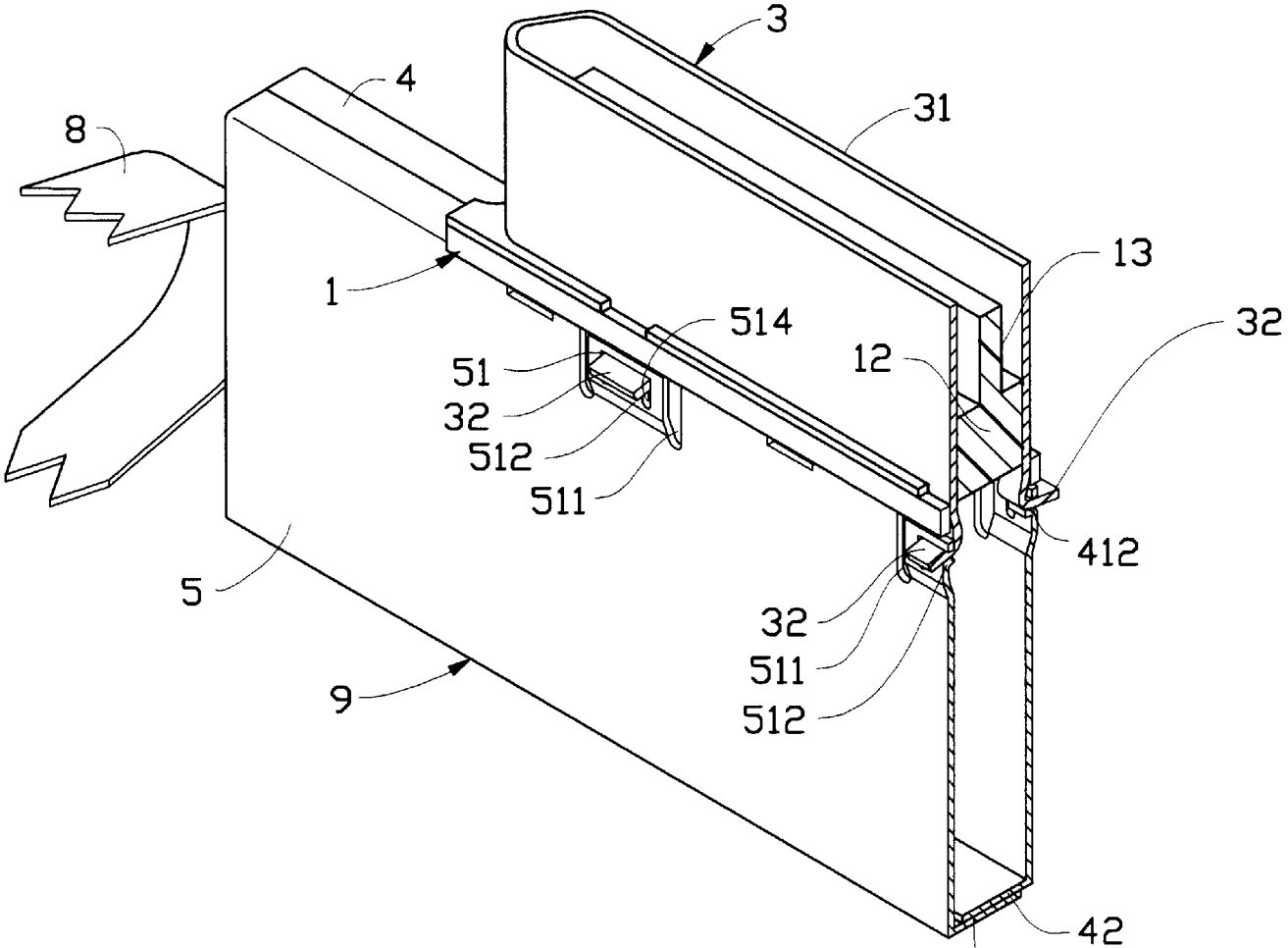
FIG. 3 is similar to FIG. 2 with a portion of the cable end connector being cut away to show an inner structure thereof.
Figure 4:
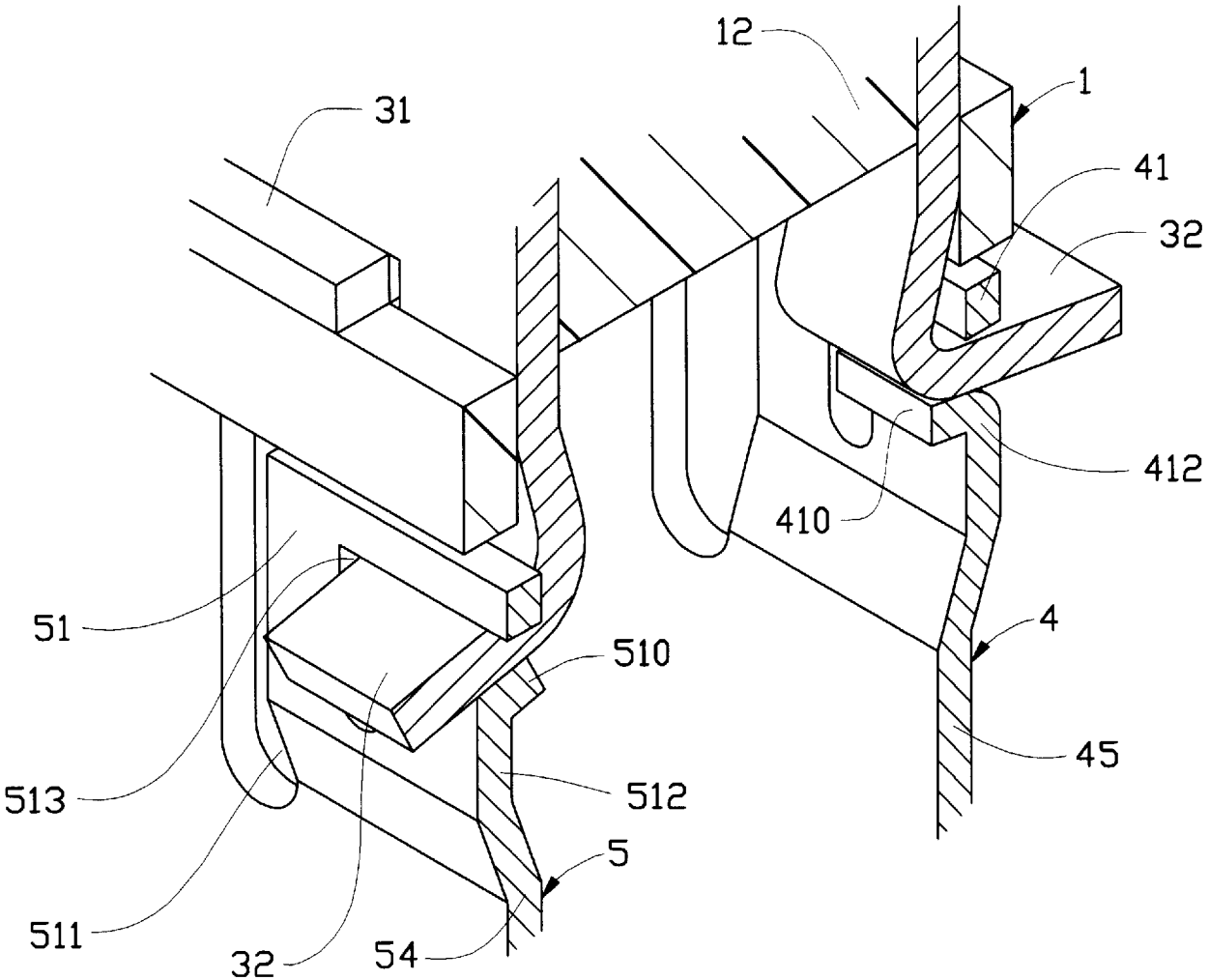
FIG. 4 is an enlarged view of a portion of FIG. 3.

A shield 3 has a base plate 33 positioned on the top face 10 of the body 1 and a shroud 31 formed on the base plate 33. The shroud 31 defines an interior space 30 for receiving the coupling section 12 of the body 10 whereby the shroud 31 is fixed to the coupling section 12 and surrounds the mating ends 22 of the contacts 2 retained in the contact support member 13 for EMI (Electromagnetic Interference) protection and electrostatic discharge purposes. The base plate 33 forms two retaining tabs 32 on each side thereof which are originally straight and extend in a direction substantially normal to the base plate 33. Each retaining tab 32 is then bent an angle to form an end piece 320 as shown in FIGS. 1, 3 and 4.

The body 1 defines openings 101 therein for receiving the original, un-deformed retaining tabs 32. The tabs 32 are then bent to form the end piece 320 whereby a space is formed between the end piece 320 and the bottom face 11 of the body 1.

A casing 9 comprises a left casing member 4 and a right casing member 5. The left casing member 4 has a wall plate 45 having edges from which a first inward flange 42 and a second inward flange 43 extend. The first flange 42 and the second flange 43 are opposite each other and the second flange 43 has a width substantially half of that of the first flange 42. Similarly, the right casing member 5 has a wall plate 54 having edges from which a first inward flange 52 and a second inward flange 53 extend. The first and second flanges 52, 53 are opposite each other and the second flange 53 has a width substantially half of that of the first flange 52. The left casing member 4 and the right casing member 5 are assembled together by fitting the first flange 42 of the left casing member 4 over the first flange 52 of the right casing member 5 whereby the first flanges 42, 52 of the casing members 4, 5 overlap each other while edges of the second flanges 43, 53 abut against each other as shown in FIGS. 2 and 3 thereby forming the casing 9 with the flanges 42, 43, 52, 53 forming an edge face.

The inward flange 43 of the left casing member 4 has a cutout 40 and the right casing member 5 has a corresponding cutout 50. The cutouts 40, 50 are aligned with each other to define an opening (not labeled) of the casing 9. The retaining legs 15 of the body 1 extend through the opening and engage with the flanges 42, 43, 52, 53 of the casing members 4, 5 whereby the body 1 is positioned on and supported by the flanges 42, 43, 52, 53 of the left and right casing members 4, 5.

A circuit board 6 is disposed in the casing 9. The circuit board 6 has first contact pads 61 which are in electrical engagement with the mounting ends 21 of the contact elements 2. The circuit board 6 further has second contact pads 62 which are electrically connected to the first contact pads 61 by means of a circuit of the circuit board 6. Each of the second contact pads 62 is soldered to a wire 7. The wires 7 extend out of the casing 9 through a cutout 44 formed in the second flange 43 of the left casing member 4. A tightening strip 8 may be attached to the left casing member 4 proximate the cutout 44 for bundling the wires 7.

Figure 5:
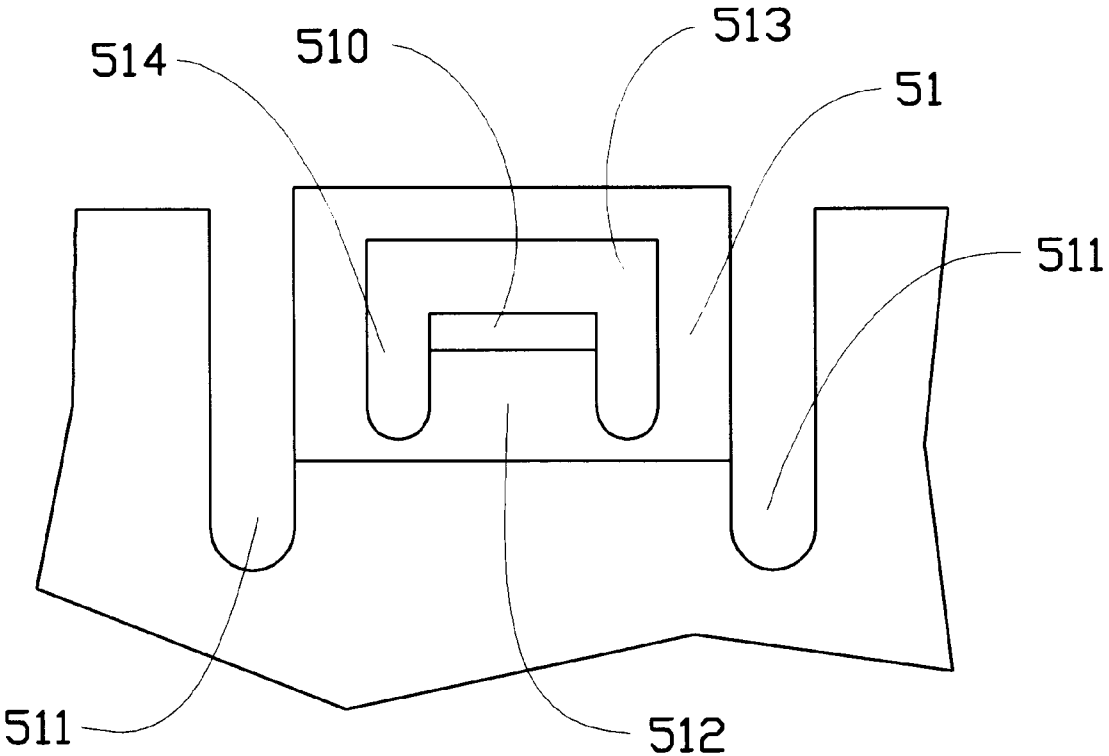
FIG. 5 is an enlarged front view of a portion of the cable end connector of the present invention.

Also referring to FIGS. 3–5, the cutouts 40, 50 of the casing members 4, 5 form a free edge 49, 59. Each free edge 49, 59 defines two slots 411, 511 which form a resilient cantilevered member 41, 51 therebetween corresponding to each of the retaining tabs 32 of the shield 3. The cantilevered member 41, 51 defines a slot 413, 513 for receiving the end piece 320 of the corresponding retaining tab 32. Two slits 414, 514 are formed in the cantilevered member 41, 51 in communication with each slot 413, 513 thereby forming a resilient cantilevered section 412, 512 having an inward flange 410, 510 for supporting the end piece 320 of the corresponding retaining tab 32 thereon. Each flange 410, 510 is formed by bending the cantilevered section 412, 512.The retaining tabs 32 of the shield 3 are bent so that the end pieces 320 thereof extend out of the casing 9 through the corresponding slots 413, 513 in an outward direction while the flanges 410, 510 of the cantilevered members 41, 51 extend in an opposite, inward directions. Thus, the end pieces 320 of the retaining tabs 32 and the flanges 410, 510 of the cantilevered sections 412, 512 are arranged in opposite directions. The bending of the end piece 320 of each retaining tab 32 allows the end piece 320 of the retaining tabs 32 to extend through the slot 413, 513 and secure the retaining tab 32 to the casing members 4, 5. By suitably bending the retaining tabs 32 and the cantilevered sections 41, 51, a secure engagement between the retaining tabs 32 and the cantilevered members 41, 51 is established.

Although the present invention has been described with reference to a preferred embodiment, it is apparent to those skilled in the art that a variety of modifications and changes may be made without departing from the scope of the present invention which is intended to be defined by the appended claims.

What is claimed is:

1. A cable end connector comprising:

an insulative body having a top face and a bottom face opposite the top face, two retaining legs extending from the bottom face, a plurality of channels defined in the body between the top face and the bottom face for each receiving a contact element, the contact element having an end extending beyond the bottom face;

a casing comprising a first and second casing members each having a wall plate, the wall plates of the first and second casing members defining a space, a first and second openings therebetween and each having edges from which inward flanges extend, the inward flanges of each casing member comprising a first flange and a second flange, the first flange having a first width and the second flange having a second width being substantially half of the first width whereby the first flanges of the casing members overlap each other while edges of the second flanges abut against each other, the first opening receiving the retaining legs of the body thereby positioning the body on the casing, each wall plate having at least one engaging slot;

a circuit board accommodated in the space between the wall plates of the casing and electrically engaging with the ends of the contact elements;

wires electrically connecting with the circuit board and extending through the second opening of the casing; and a shielding member mounted to the top face of the body, the shielding member forming a retaining tab corresponding to each engaging slot of the wall plates, the retaining tab extending through a hole defined in the body and engaging with the engaging slot.

2. The cable end connector as claimed in claim 1, wherein the retaining tab inserted into the engaging slot of the wall plate is bent at an angle thereby forming a bent portion.

3. The cable end connector as claimed in claim 2, wherein the engaging slot has an inclined flange formed therein, the flange extending in a direction substantially opposite to the bent portion of the retaining tab.

4. The cable end connector as claimed in claim 3, wherein the engaging slot has a resilient cantilevered section formed therein, the flange extending from the cantilevered section.

5. The cable end connector as claimed in claim 4, wherein each wall plate defines two slots therein forming a cantilevered member therebetween, the engaging slot of the wall plate being defined in the cantilevered member.

6. The cable end connector as claimed in claim 1, wherein the shielding member comprises a base plate positioned on the top face of the insulative body.

7. The cable end connector as claimed in claim 1, wherein the insulative body comprises a coupling section extending from the top face thereof, the shielding member comprising a shroud fit over and surrounding the coupling section, the channels receiving the contact elements being further defined in the coupling section whereby a portion of the contact elements located in the coupling section is surrounded and shielded by the shielding member.

8. The cable end connector as claimed in claim 1, wherein the inward flanges of each casing member define a cutout aligned with each other to define the first opening of the casing.

9. The cable end connector as claimed in claim 1, wherein the casing comprises a tightening strip attached thereto proximate the second opening for bundling the wires.

10. A cable end connector comprising:

an insulative body defining top and bottom faces with openings therein;

a shielding member mounted to the top face of the insulative body, said shielding member including a plurality of retaining tabs extending through the openings of the insulative body and out of the bottom face for securing the shielding member to the insulative body;

a casing positioned on a rear portion of the insulative body, said casing including a plurality of engaging slots in a front edge abutting against the bottom face of the insulative body; wherein said retaining tabs are latchably received within the corresponding engaging slots, respectively.

11. The cable end connector as claimed in claim 10, wherein said engaging slot is formed in a cantilevered member.

12. The cable end connector as claimed in claim 10, wherein a flange is provided within the engaging slot for abutment against the retaining tab.

* * * * *